United States Patent [19]

Caporusso et al.

[11] Patent Number: 5,022,249

[45] Date of Patent: Jun. 11, 1991

[54] PORTABLE MANUALLY-CONTROLLED THREE-SPEED PIPE-BENDING MACHINE

[76] Inventors: Alessandro Caporusso; Mario Caporusso, both of Via Pantanelle 21, Piedimonte San Germano, Frosinone, Italy

[21] Appl. No.: 363,406

[22] Filed: Jun. 2, 1989

[30] Foreign Application Priority Data

Jun. 17, 1988 [IT] Italy ..... 48094 A/88

[51] Int. Cl.[5] ..... B21D 7/04

[52] U.S. Cl. ..... 72/149; 72/155; 72/443; 72/444; 72/459

[58] Field of Search ..... 72/149, 155, 156, 443, 72/458, 459, 383, 444

[56] References Cited

U.S. PATENT DOCUMENTS

| | | | |
|---|---|---|---|
| 1,849,181 | 3/1932 | Francis . | |
| 2,986,195 | 5/1961 | Landis . | |
| 3,236,082 | 2/1966 | Beck et al. | 72/149 |
| 4,249,407 | 2/1981 | Fogleman | 72/217 |
| 4,532,787 | 8/1985 | Caporusso et al. | 72/149 |
| 4,760,727 | 8/1988 | Van Landingham | 72/149 |

FOREIGN PATENT DOCUMENTS

| | | | |
|---|---|---|---|
| 0299792 | 1/1989 | European Pat. Off. . | |
| 993643 | 11/1951 | France . | |
| 0255721 | 11/1986 | Japan | 72/149 |

*Primary Examiner*—David Jones
*Attorney, Agent, or Firm*—Young & Thompson

[57] ABSTRACT

Portable manually-controlled pipe-bending machine designed for operation at three different speeds, consisting of a boxlike main body, which in its simplest form contains two gear assemblies i.e.: a speed reducer with cooperating gears mounted on three parallel axes, corresponding to three different speeds which are obtained by fitting a conventional handle or any other appropriate structure into a socket driving a gear shaft, and thus making the reduction gear rotate at the desired speed; and a transmission mechanism which is connected with the output gear of the speed reducer and which transmits to a gear train up to the final gear to turn the main driving shaft integral with it and mounting the bending member or matrix. The machine is provided with an auxiliary device performing an intermediary function, which is either separate from the machine and can be connected with one of the three sockets of the speed reducer or is built in the main body, the friction coupling function of this auxiliary device being to allow the engagement/disengagement of the transmission mechanism.

3 Claims, 4 Drawing Sheets

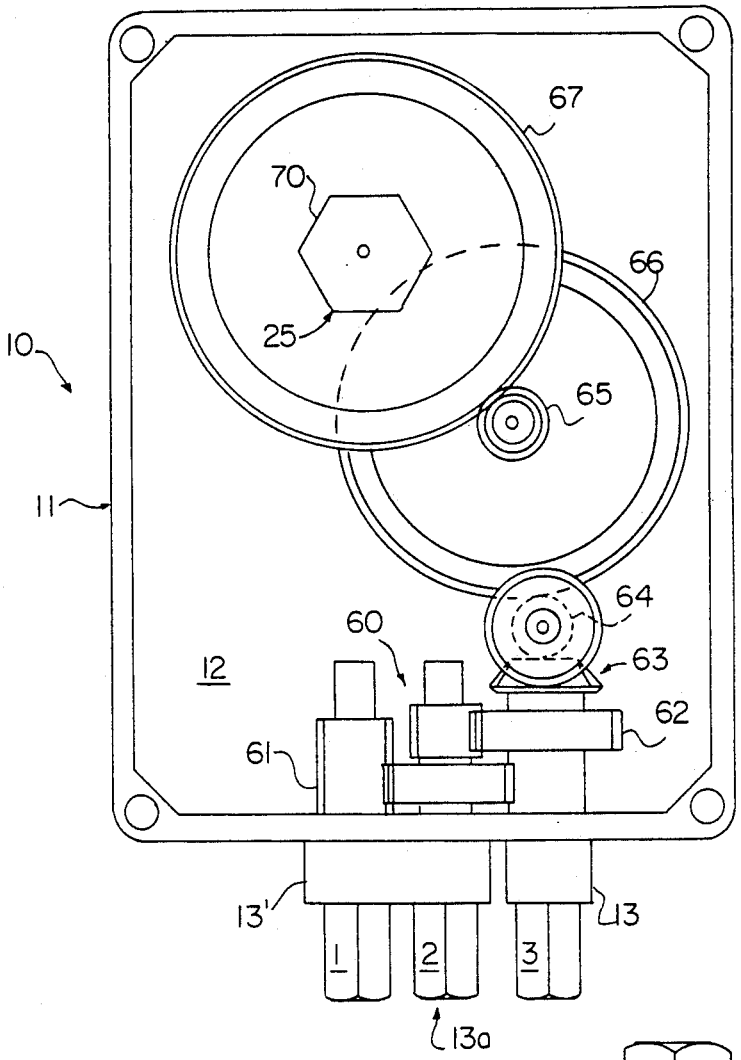
FIG. 3
FIG. 4
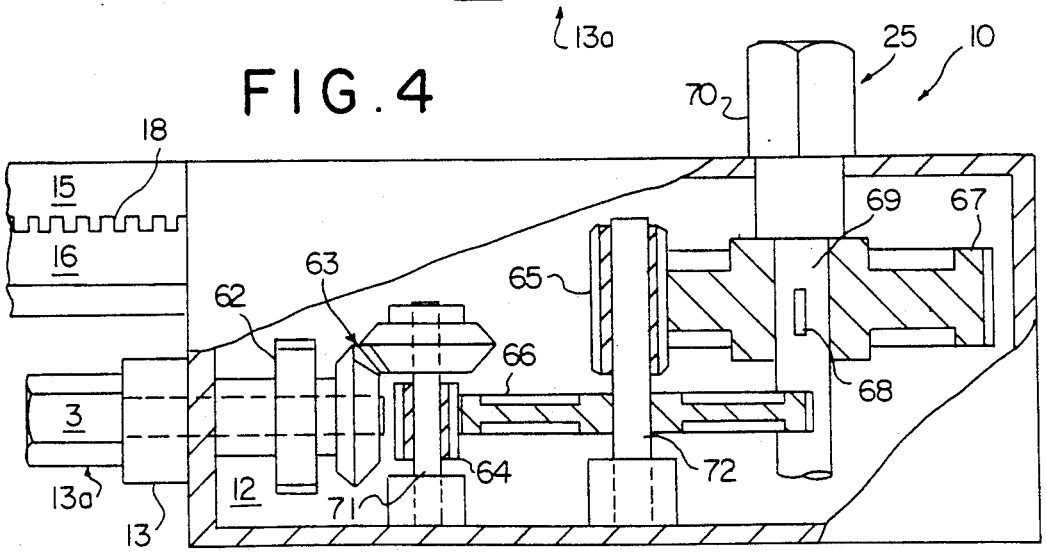

PORTABLE MANUALLY-CONTROLLED THREE-SPEED PIPE-BENDING MACHINE

This invention relates to a portable manually-controlled pipe-bending machine designed to operate at three different speeds, and consisting of a boxlike main body, which in its simplest form contains two gear assemblies i.e.: a speed reducer with cooperating gears mounted on three parallel axes, corresponding to three different speeds which are obtained by fitting a conventional handle or any other appropriate means into a socket driving a gear shaft, and thus making the reduction gear rotate at the desired speed; and a transmission mechanism which is connected with the output gear of the speed reducer and which transmits motion to a gear train up to the final gear to turn the main driving shaft which is integral with it and mounts the bending member or matrix. The machine is provided with an auxiliary device performing an intermediary function, which is either separate from the machine and can be connected with one of the three sockets of the speed reducer or is built in the main body, the friction coupling function of said auxiliary device being to allow the engagement/disengagement of the transmission mechanism.

Prior art in the field of pipe bending, particularly as far as pipes intended for use in sanitary plumbing are concerned, presents several embodiments. Engineers, manufacturers and scholars also have devoted attention to portable applications using manually-controlled pipe-bending machines or apparatuses, and have made efforts to design machines having such constructional and operational features as to prove satisfactory even when the machine is operated at the location where the bent pipes are to be installed, and they have as well made suggestions and design attempts taking into account the usefulness, or necessity, of producing a bent pipe free from deformations, breaks, or cracks, which are particularly likely to occur if the material, diameter, and thickness of the pipe are more sensitive to stretching stresses during the bending operation.

To the best of the Applicant's knowledge, however, no adequate attention has been devoted so far to the production of a portable manually-controlled pipe-bending machine which because of its actual portability and ease of operation features, as well as because it can be used to bend pipes at the location where the pipe is to be installed, is able not only to yield satisfactory results but also to allow the machine to operate at different speeds so that it may be fit for bending pipes differing in size and requiring great care during the bending operation.

The main aim of this invention is to provide a portable manually-controlled pipe-bending machine wherein the use of a conventional halfround-grooved bending member or matrix, able to produce up to 180° bends, is combined with the use of a countermatrix having a specially shaped groove, and mounted on the pin of a moving slide which can be set to the desired position by running between parallel radial guides, machined in the boxlike main body, along a rack, the whole having the features described, illustrated, and claimed in the pending Italian patent application No. 47851A/88, filed on Apr. 15, 1988 by the Applicants.

The major innovative features of the pipe-bending machine according to this invention are two: the ability to operate at three different speeds; the use of an auxiliary device—either separate from and connectable to the machine or built in the machine main body—which is designed, on the one hand, to engage, by friction or through an appropriate coupling, a shaft actuated by a torque generally produced by manual action, with the machine transmission mechanism which in turn produces the resisting torque needed to make the matrix rotate in a reliable and easy manner, and, on the other hand, to automatically disengage the clutch or coupling elements when, even though accidentally, the amount of resisting torque exceeds that of the driving torque which is thus induced to idle.

According to this invention the three-speed manual control innovation is accomplished by using a speed reducer consisting of three gears mounted on three parallel and co-operating axes of rotation allowing the user to operate the gear(s) on each axis with a different velocity ratio between the parallel and adjacent axes. The parallel axes of rotation lie generally on the same horizontal plane and the final gear of the speed reducer is in turn connected with the first element of a train of gears constituting the transmission mechanism built in the machine main body and which eventually serves to rotate the main driving shaft mounting the matrix. The main shaft axis lies on a plane normal to said axes of the speed reducer, therefore, in order that the latter may be connected with the transmission mechanism a mechanical coupling is necessary which is suitable to connect axes normal to each other.

In order to better explain the concepts informing the invention, and allow the skilled in the art to design any possible embodiments which may arouse greater interest from the user, as well as to highlight the advantages that may be obtained from the use of a portable manually-controlled pipe-bending machine according to this invention, the main constructional and operational features of typical embodiments are described here below.

The description makes reference to the accompanying drawings in which:

FIG. 3 is a schematic top view of the transmission mechanism built in one component section of the machine main body shown in FIG. 1;

FIG. 4 is an elevation sectional view taken on one side of FIG. 3, of the transmission mechanism with part of the gearing shown sectionally and made apparent by cutting away a portion of the main body;

Figures 1, 2, 5, 5A:
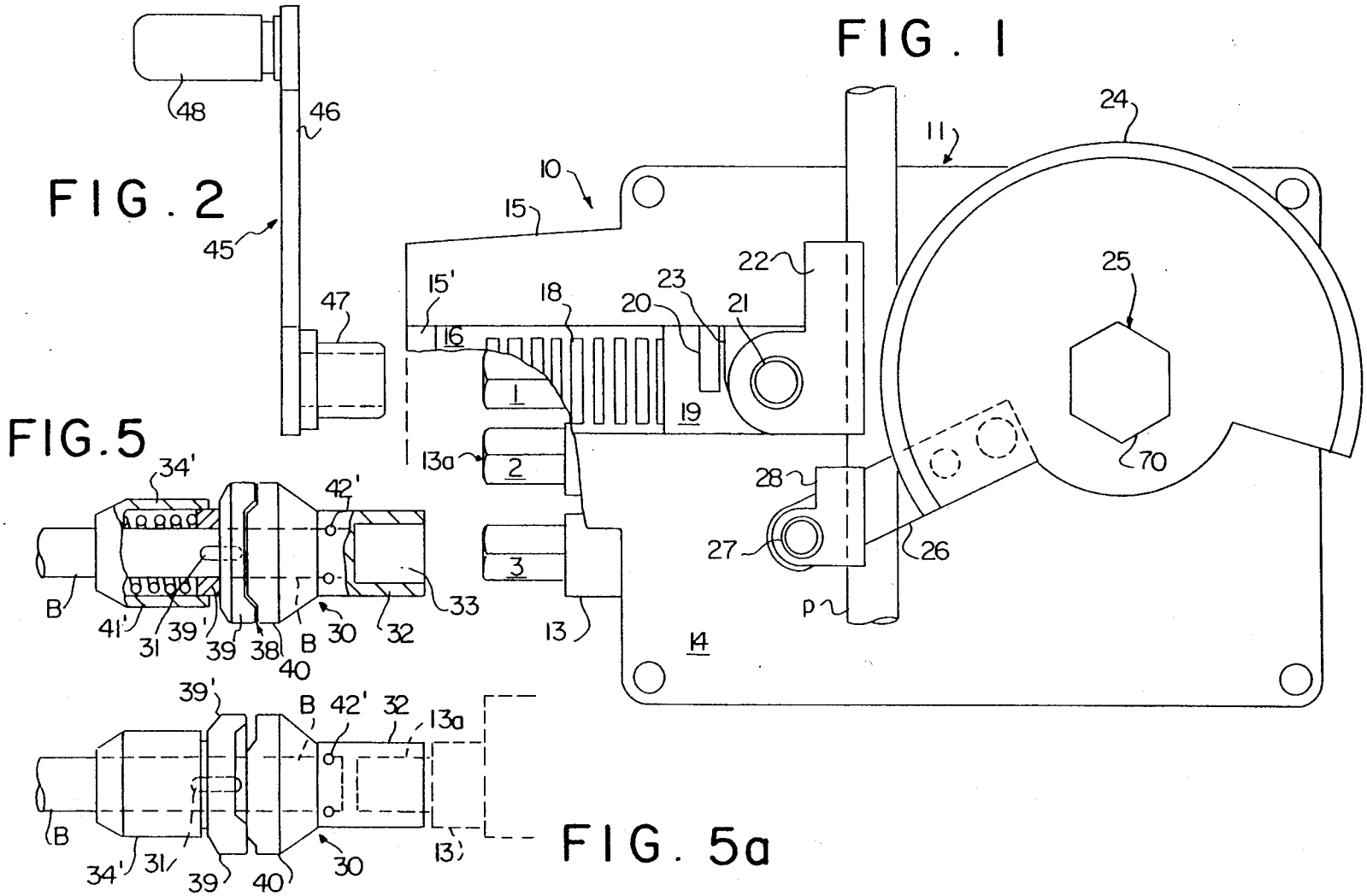
FIG. 1 is a schematic top view of an embodiment of a portable three-speed manually-controlled pipe-bending machine.
FIG. 2 is a schematic view of a handle to be used for controlling the machine shown in FIG. 1 at one of three available speeds.
FIG. 5 is an almost entire longitudinal section of an auxiliary device of the pipe-bending machine shown in FIG. 1, including a coupling and used as an intermediary means in a manually- or electromechanically-controlled system, and which can be fitted on one of the three sockets providing different speeds of the machine, the coupling being shown with its two jaws in the engaged position.
Figure 6:
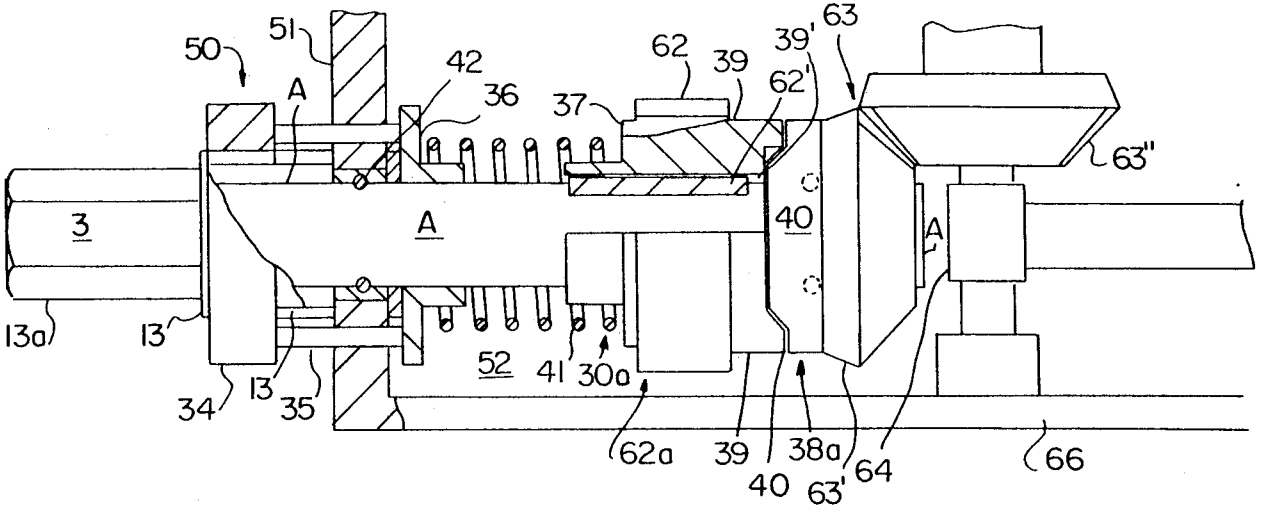
Figure 7:
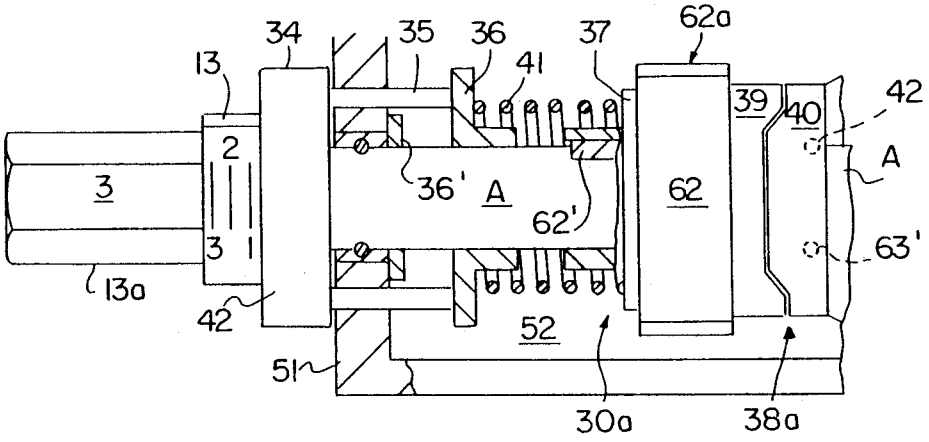
Figure 8:
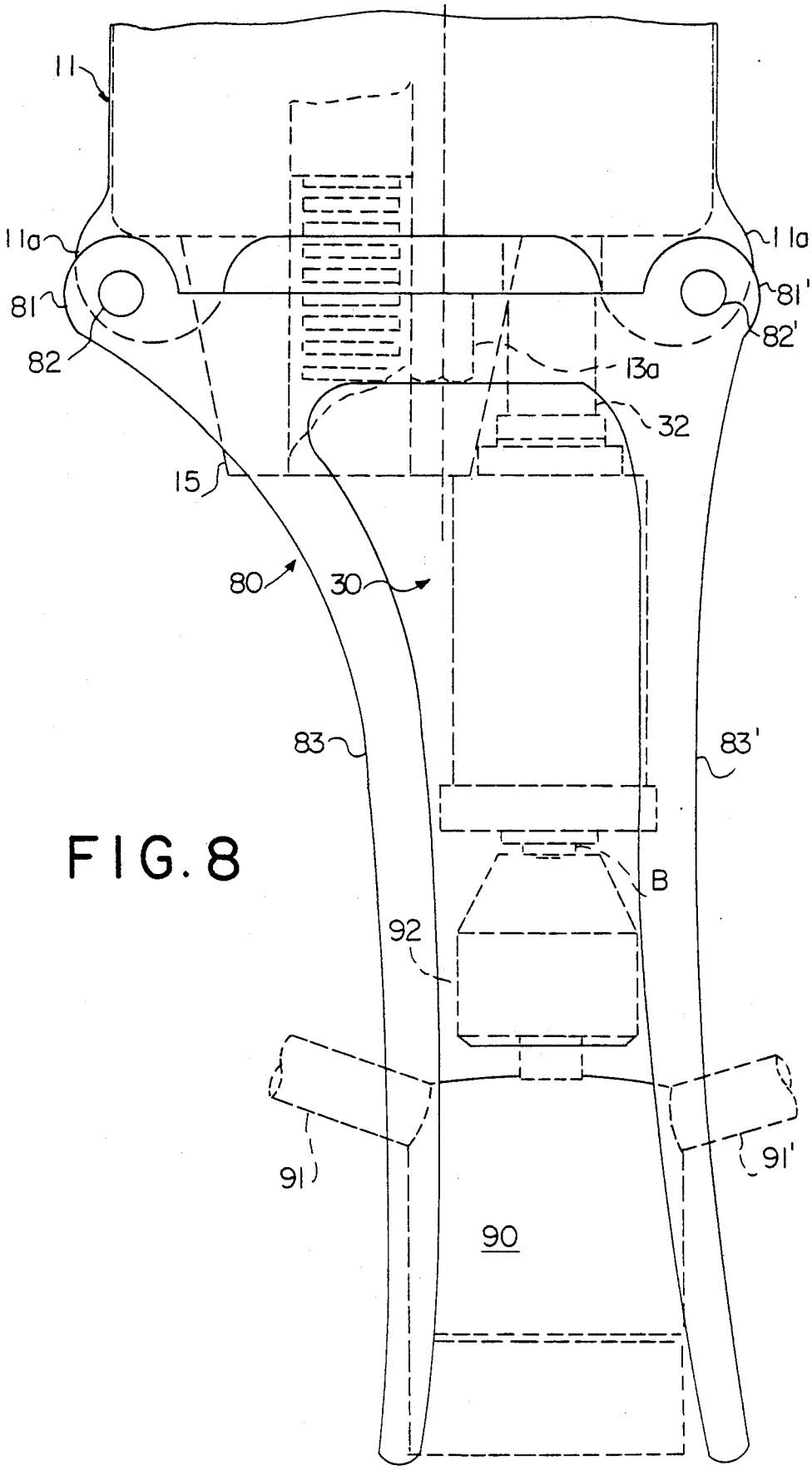

FIG. 5*a* is a schematic view similar to FIG. 5 with the two jaws disengaged;

FIG. 6 is a larger-scale detailed schematic view of a second embodiment of the machine according to this invention, in which an auxiliary device similar to the one shown in FIG. 5, is built in the machine main body shown in FIG. 1, as an intermediary means located between the 3rd speed socket and the transmission mechanism driving the bending member or matrix; this device can be adjusted according to the desired speed and is shown in the figure as set for the 3rd speed;

FIG. 7 is a detailed schematic view of the auxiliary device alone, which is similar to the one shown in FIG. 6, and is here set for the 1st speed;

FIG. 8 is a schematic top view of a forklike device which can be mounted on the main body of the pipe-bending machine for the purpose counteracting the initial clockwise and counterclockwise peak torques of an electric drill connected with the external auxiliary device.

Let us now examine the accompanying drawings, beginning with FIGS. 1, 3 and 4: a person skilled in the art can easily note that the transmission mechanism used for the manual control of a pipe-bending machine (10) according to this invention, essentially consists of a gear train (60) having a speed-reducing function. The meshing of these gears allows the operator to make the main gear (67) of the transmission mechanism, and hence the bending member, rotate at the bending speed which was selected by fitting a handle (45) or auxiliary intermediary device (30) on the appropriate socket (13*a*). In this regard, it may be mentioned that the sockets (13*a*) driving the speed reducer (60) should preferably work with a 1:3 ratio between the speeds indicated with reference numbers 1 and 2, and a 1:2 ratio between the speeds indicated with reference numbers 2 and 3, in order to obtain the desired speed. Therefore, the direct control of gear (61) obtained by actuating the 1st speed socket (13*a*), would, according to this embodiment, cause the shaft of gear (62) rotate with 1:6 velocity ratio approximately, which is to be considered as the lowest speed in this embodiment.

The parallel axes of speed reducer (60) gears may generally be considered to be horizontal in this boxlike main body (11) which can be placed on a work surface or work bench to carry out the bending operation on site. At any rate, said axes are normal to the main driving shaft (25) axis on which is to be mounted a matrix (24) which is assumed to be of a conventional type and provided with a radial protrusion (26) whose free end mounts, as in normal practice, an interchangeable guide support (28) freely rotating about pin (27) and whose groove faces the groove of interchangeable matrix (24). As shown in the schematic views of FIGS. 3 and 4, gear (62) is connected with the main vertical driving shaft (25) through a pair of bevel gears (63), and the transmission mechanism consists of a speed reducer gear train extending from gear (64) rotating about a vertical intersecting shaft, up to gear (67) rotating about said main driving shaft (25), with a speed reduction ratio that allows the operator to manually control the pipe-bending machine (10) with pipe (p) to be bent running at a suitable linear speed between the selected matrix (24) and the countermatrix (22).

It is pointed out that in this embodiment: the matrix (24) is assumed to have a bending member of a conventional type with the centerline of its half round groove lying on a horizontal plane at constant distance from the top surface of main body (11); the groove in countermatrix (22) is assumed to be as described, illustrated, and claimed in Italian patent No. 1.147.601 granted to the Applicants on Nov. 19, 1986 which is mentioned herein as background; and the slide (19), including the countermatrix mounting pin (21) and running on rack (16) located between the radial guides of protrusion (15) on the top surface (14) of the machine and having the function of allowing the correct positioning of the countermatrix in front of the matrix, is assumed to be as described in pending Italian application No. 47851A/88 filed on Apr. 15, 1988 by the Applicants.

Based on the preceding description and the illustrations of FIGS. 1 through 4, an innovative feature of this invention is the possibility of manually controlling the matrix (24) at three different speeds to be selected according to the diameter, thickness, and material of the pipe to be bent. In particular, FIG. 3 shows that the operator can turn the handle (45) clockwise to obtain speeds 1 and 3, and counterclockwise to obtain the intermediate speed 2, as determined by the way the gears of speed reducer (60) are arranged.

The numerous experiments conducted by the Applicants have, however, provide that the schematically illustrated pipe-bending machine (10) lends itself quite well to being controlled electromechanically by using an auxiliary device (30) which has been designed and constructed for said purpose to act as an intermediary element between a conventional electromechanical device, such as for instance a portable electric drill, and one of sockets (13*a*) of machine (10), when the direction of rotation of the two elements so interconnected is the one designed to carry out a bending operation, that is the clockwise direction to actuate the sockets available for the 1st and 3rd speed, or to obtain the return of matrix (24) to the starting position, and the counterclockwise direction of the 2nd speed socket.

In order that an auxiliary device (30) may be utilized as just described, according to the innovative feature of this invention, it is required to be such as to provide the necessary safety of the operator while he is carrying out a bending operation, as well as automatic disengagement when the resisting torque grows to an amount such that the driving torque being applied may turn out to be dangerous or at least inexpedient. The above mentioned experiments have suggested the use of an auxiliary device (30) designed to be fitted on the 3rd speed socket attached to gear (62) of reducer (60), and comprising a coupling (38) consisting of opposite coaxial jaw elements (39–40), or elements of the type used in clutch couplings performing similar functions. The coupling is adjustable in order that should the resisting torque developed by the bending operation grow to an unsuitable or even dangerous value the elements of coupling (38) will automatically be disengaged so as to idle the driving torque and thus render the operation of machine (10) more reliable and safer.

In order to simplify the illustration, the auxiliary device (30) shown in FIG. 5 has been assumed to consist of a coupling (38) made up of two coaxial opposite sector elements (39) and (40) which, when interlocked, are stressed by a cylindrical coil compression spring (41') acting between the shoulder created by the edge of one protrusion (39') of element (39) and the inner bottom of a coaxial bell cap (34') which has the function of controlling the spring (41') compression. Coupling (38) and bell cap (34') are carried by a driving shaft (B) unconstrainedly mounted in their through holes, but are held in a specified position by means of, for instance, guide rings (42'). The key (31) on shaft (B) is provided to make the sector element (39) of coupling (38) rotate together with shaft (B) and it will make the opposite coaxial sector element (40) also rotate when these two elements (39) and (49) are engaged, as shown in FIG. 5, due to the action of compression spring (41'). The coaxial protrusion (32) of element (40) of coupling (38) has a blind hole (33) shaped in such a way that it may be fitted onto one of sockets (13*a*) which has been assumed to be the 3rd speed socket in FIGS. 5 and 5*a*, the 3rd speed being the highest available in this embodiment of pipe-bending machine (10). If the resisting torque developed during a bending operation should, for any reason, exceed the value to which spring (41') compression has been set, the rotation control action applied to shaft (B) will cause the coupling sectors of element (39) to slip on those of element (40), thus causing shaft (B) to rotate freely because the two elements are disengaged, as schematically shown in FIG. 5*a*.

It may be mentioned, for information, that the power transmitted will amount to 180 Kgm approximately when the lowest speed identified by number 1 on the corresponding socket (13*a*) is used as the speed most suited for the bending of large-diameter, generally up to 42 mm, pipes, and the power transmitted will amount to about 60 Kgm and 20 Kgm, respectively, when speeds identified by numbers 2 and 3 are used as the speeds suited for the bending of 28 mm and 20 mm diameter pipes, respectively. The auxiliary device (30) could supposedly be designed to be adjustable to adapt itself to each of sockets (13*a*), however, in this embodiment designed to make use of an auxiliary device (30) which is external and connectable to a pipe-bending machine (10), the factory presetting of the compression spring may be considered to be sufficient, supposing for instance that the bell cap (34') is mounted by screwing it on a threaded portion of shaft (B) and the device (30) is fitted into socket 3.

It should be specified at this point, that especially if an electric drill is used as a device providing the driving torque to be applied to one socket (13*a*) of the pipe-bending machine (10) through the auxiliary intermediary device (30), the initial clockwise and counterclockwise peak torques may be such as to make it more difficult for the operator to carry out the bending operation with one hand only. In order to obviate this inconvenience a special device has been designed for the purpose of counteracting the adverse influence of said peak torques, and an embodiment of this device is schematically shown in FIG. 8.

It can be seen from FIG. 8 that the lower portion of structure (11), better illustrated in FIG. 1, is provided with two lugs (11*a*—11*a*) projecting from the corners of the main body side carrying sockets (13*a*) providing the three speeds available in this type of pipe-bending machine. The projecting element (32), with a hexagonal blind hole (33), of the previously described first embodiment of engaging/disengaging external auxiliary device (30), is fitted into the socket (13*a*) providing speed 3 which is best suited for the electric control of the transmission mechanism that drives the main shaft mounting matrix (24). Shaft (B) of device (30) protruding from the opposite end of the latter is held by the chuck (92) of a drill (90) to be driven in either direction of rotation as provided for and/or allowed by the electric drill motor and set by the operator; the body of drill (90) is provided with two mirror image diverging long protrusions (91,91') acting as peak dampers, and which support the long tines (83, 83') of a forklike device which is locked to structure (11) since its protrusions (81, 81') are mounted on pins (82, 82'), respectively, extending upward from and held in position by lugs (11*a*) of main body (11).

It will be easily understood that the above described forklike device (80), being firmly secured to pins (82, 82') of structure (11) is able to exercise an effective peak torque damping action in either direction of rotation of the electric drill motor shaft.

A person skilled in the art will then easily understand the enhanced ease of operation and consequent greater advantage of an embodiment of the invention where the auxiliary device previously identified by (30) in FIGS. 5 and 5*a*, and intended to perform an engaging/disengaging function at the three different speeds 1, 2 and 3, is built in the main body of a pipe-bending machine and is connected with the transmission mechanism of the machine to bend pipes (p) as previously described.

An example of this interesting embodiment will be described here below with reference to FIGS. 6 and 7 in which the component parts of the device in question built in the main body (51) of a three-speed pipe-bending machine (50) are identified by the same reference numbers as used for the similar device (30) shown in FIG. 5, which was previously considered to be separate from the pipe-bending machine (10) and able to be operated independently by the user, even electrically, when fitted into the 3rd speed socket of the pipe-bending machine (10).

In view of the above, FIGS. 6 and 7 have been drawn on a larger scale and they represent the auxiliary device alone as built in the main body (51) of a pipe-bending machine (50), and coaxial with socket (13*a*) providing the 3rd or highest speed of the machine, the other transmission elements driving matrix (24) being the same as those previously described and illustrated. This embodiment too, as schematically shown in FIGS. 6 and 7, is assumed to be provided with a sector coupling (30*a*) made up of a pair of opposite coaxial sector elements (39, 40).

In this embodiment, the auxiliary device built in the main body (51) of pipe-bending machine (50), and identified by (30*a*) in FIGS. 6 and 7, is located between the inner vertical wall of the structure and the transmission mechanism; in particular, the sector coupling (39, 40) is located between the final gear (62) of speed reducer (60) and the bevel gear (63) of the transmission mechanism, as schematically shown in detail in FIGS. 3 and 4 of the trasmission mechanism of a three-speed, manually controlled pipe-bending machine (10).

It can be seen from FIGS. 6 and 7 that the auxiliary device (30*a*) built in the main body (51), has been assumed to be designed with said gear (62) having two protrusions (37) and (39) forming a single unit with it but located at its opposite ends, the protrusion (37) being used as a shoulder for one end of a coil compression spring (41), the shoulder on the opposite end of the spring being identifield by number (36); the opposite protrusion (39) is shaped in such a way as to form one of the sector elements of coupling (38*a*) having the function of engaging/disengaging the other element (40) of the coupling, as previously described and illustrated in FIGS. 5 and 5*a* showing the device (30). The holes passing through said spring-holding shoulders (36) and (37), in gear (62), in coupling (38*a*), and in bevel gear (63') forming a single unit with element (40) of coupling (38*a*), provide a seat for the free rotation of a shaft (A) extending from the front of main body (51) into a hole passing through an externally threaded cylindrical piece (13) which is integral with the vertical wall of said main body. The coaxial socket (13*a*) providing the 3rd speed at which the machine (50) is desired to operate forms an outer head integral with shaft (A).

The shaft (A) is held in a specified position by at least one guide ring (42), or similar means, in order that it may freenly rotate when the elements of coupling (38*a*) are in a disengaged position (as described and illustrated concerning coupling (38) in the position shown in FIG. 5*a*), and is provided with a key (62') on which runs the longitudinal keyway (39') machined in the single piece (37-62-39).

As mentioned previously, the amount of power transmitted changes according to the size of the pipe to be bent and requires the user to operate the machine at the appropriate speed he can select from the three available ones. In order that the coupling (33*a*) in this embodiment using an auxiliary device (30*a*) built in the main body of a pipe-bending machine (50), as described and illustrated in FIGS. 6 and 7, may be automatically disengaged, as a useful and/or necessary feature, the compression of spring (41') must be suitably adjusted using means which in this embodiment have been assumed to consist of pins (35) passing through the vertical wall of structure (51) and pushed against shoulder (36) of spring (41') by turning a threaded ring (34) screwed on the externally threaded cylindrical protrusion (13) which is integral with said vertical wall. The amount of compression of spring (41') mounted on shaft (A) whose head (13*a*) is the one providing the 3rd speed, is adjusted according to the three operating speeds of this pipe-bending machine (50), which are indicated as 1, 2 and 3, and which range from the lowest speed suitable for the maximum transmitted power, to the highest speed suitable for the minimum transmitted power, the values of which have been above indicated in a general manner to make it easier to interpret the innovative features of the invention.

It is obvious that the use of either an external manual control device such as a lever (45) (FIG. 2), or an electromechanical control device, such as for instance the chuck of an electric drill with flexible cable, fitted onto said socket (13*a*) providing the highest speed 3, will prove to be suitable to clockwise rotate said socket during the time the transmission mechanism of the machine is operating to bend a pipe (p). If the above mentioned control devices are fitted into the socket (13*a*) corresponding to speed 1, and turned clockwise, the bending operation will be carried out at the lowest speed, whereas, if they are fitted into the socket (13*a*) corresponding to speed 2, and still turned clockwise, the matrix (24) will be returned to the starting position.

Thus, the skilled in the art can easily understand that the use of the first simpler embodiment wherein the pipe bending machine (10) is operated in a manual manner only by means of handle (45), will permit:

1. bending a pipe (p) at the lowest speed 1;
2. bending a pipe (p) at the highest speed 3 by turning handle (45) clockwise, when it is fitted onto the socket (13*a*) corresponding to speed 3;
3. bending a pipe at the intermediate speed 2 by turning handle (45) counterclockwise, when it is fitted onto the socket (13*a*) corresponding to speed 2.

This short explanation will prove useful when the pipe bending machine (10) is operated using the auxiliary engaging/disengaging device (30) including the coupling (38), which in the second embodiment of the invention is an external device designed to be fitted onto one of sockets (13*a*) to be selected according to the speed at which matrix (24) is desired to rotate for bending purposes or for returning to the starting position, whereas in the third embodiment, it is built in the main body (51) of a machine (50) wherein all other members are substantially the same as described and illustrated concerning the first simple embodiment of a pipe bending machine (10) designed to be manually controlled at three different speeds corresponding to sockets (13*a*) 1, 2, 3.

The use of the auxiliary engaging/disengaging device through a coupling or suitable clutch, wherein the disengagement is automatic and determined by the resisting torque being greater than the driving torque applied to the transmission mechanism connected with final gear (62) of reducer (60) in both machines (10) and (50), will in substance permit different manual and/or mechanical control conditions. Referring to numerals 1, 2, 3 identifying the three sockets (13*a*) corresponding to the speeds of the machine (10) or (50), said auxiliary device including coupling (38) or (38*a*) can favor the following operations:

socket (13*a*/1): manual control in the clockwise direction for the bending of pipes at the lowest speed;
socket (13*a*/2): manual control in the counterclockwise direction for the bending of pipes, and in the clockwise direction for the homing of the matrix;
socket (13*a*/3): manual control in the counterclockwise direction for the bending of pipes at the highest speed.

or:

sockets (13*a*/1/2/3): manual control for the bending of pipes and/or the homing of the matrix at the lowest, intermediate, and highest speed, respectively;

or:

sockets (13*a*/1) or (13*a*/2): motorized control for the bending of pipes and/or the homing of the matrix;
socket (13*a*/2): for the homing of the matrix;
socket (13*a*/1): manual control for the bending of pipe.

Turning back to the prevalent use of the three-speed manually controlled pipe bending machine (10) with an automatic disengaging auxiliary device provided with a sector coupling, especially if the latter is built in the main body (51) of a pipe bending machine (50) according to the description of the accompanying drawings, there is no doubt that the availability of three different output speeds provided by said auxiliary device allows a more rational use of the torque at the speed one selects, inasmuch as the driving torque developed by operating either a control handle (45) or, for instance, an electric drill chuck, fitted into one socket (13*a*), is not altered nor is it adversely and/or dangerously affected by an opposing greater resisting torque which might be developed even accidentally in the matrix (24) control transmission mechanism.

It is worthwhile to repeat now that each embodiment of this invention hereinbefore described and illustrated in the accompanying drawings, does not limit the construction of a pipe bending machine (10) or (50), able to be controlled manually at three different speeds of the pipe bending matrix (24), with or without the help of a device (30) designed either as an external intermediary means to be connected with the machine transmission mechanism, or as an intermediary means built in the main body (51) and similarly connected with the machine transmission mechanism. Therefore, any changes and/or modifications which are deemed to arouse greater interest from the constructional and practical standpoint—for reasons of better operation and/or lower cost advantages—shall be within the scope pointed out in the description of the embodiments, and are to be considered as part of the appended claims.

Said changes and modifications, to be uderstood as mentioned above, may concern, in particular:

(1) the type of adjustable coupling or clutch, in the auxiliary device (30) or (30*a*) which has been assumed, in the embodiments submitted to be made up of a pair of sector, coaxial, opposed engaging/disengaging elements (39), (40);

(2) the means and method used to control the auxiliary device engaging/disengaging condition which, in the example described and illustrated as coupling (38*a*), has been assumed to make use of slide pins (35) that move the compression spring shoulder (36) under the control of a ring (34) which is either screwed on or unscrewed from an externally threaded fixed support (13) opposing the compression action of a cylindrical coil spring (41') and thus adjusting the spring torque;

(3) the interconnection of the transmission mechanism components which changes the rotation about a horizontal axis of output gear wheel (62) of speed reducer (60) into rotation about a vertical axis of main driving shaft (70) mounting matrix (24); said connection, supposed to be accomplished by means of the pair of bevel gears (63) being replaceable, according to another embodiment, by a worm-helical gear coupling.

We claim:

1. A portable manually-controlled pipe-bending machine designed for operation at three different speeds, with a driving device including a coupling making use of driving torque produced by torque-generating means and having means for automatic disengaging of pipe-bending members of the machine when a resisting torque on the members is developed which is greater than the driving torque on the members, comprising:

a) a speed reducer assembly (60) comprising gear wheels meshing with each other and having torque inputs comprising sockets (13*a*) rotatable on three parallel axes (1, 2, 3), said gear wheels being such that selective rotation of said sockets (13*a*) at the same angular velocity selectively produces three different speeds of rotation of one of said pipe-bending members;

b) a transmission mechanism comprising a gear train that transmits the rotating motion of a gear wheel (62) of said speed reducer assembly (60) to a gear wheel (67) of said transmission mechanism to turn a shaft (25) integral with said one pipe-bending member (24) of said pipe-bending machine (10), said axes being perpendicular to said shaft (25);

c) said driving device (30) being separate from the machine but adapted to be connected with any selected one of said sockets (13*a*), said driving device (30) including a coupling (38) made up of coaxially connected sector elements (39, 40) mounted on a common driving shaft (B) which extends through holes passing through said sector elements (39, 40) of said coupling (38) and through a hole passing through an oblong bell cap (34') which is coaxial with said sector elements (39, 40) and surrounds said common driving shaft (B) and which in turn houses a cylindrical coil compression spring (41') which surrounds said common driving shaft (B) and whose ends rest respectively on shoulders consisting of an edge of a protrusion (39') of one said coupling element (39) and an inner bottom of said bell cap (34'), means for adjusting the amount of compression of said spring (41') by changing a distance between said shoulders;

d) the other said coupling element (40) having a protrusion (32) having a blind hole shaped to engage selectively and non-rotatably each said socket (13*a*);

e) said common driving shaft (B) being freely rotatable within said other coupling element (40) and being held in a fixed axial position with respect to said auxiliary device (30) by means of a guide ring (42') in said other coupling element (40), said elements (39, 40) of said coupling (30) being disengageable from each other by translatory motion of said one coupling element (39) on said common shaft (B), there being a key (31) and keyway between said one coupling element (39) and said common shaft (B) permitting said translatory motion of said one coupling element (39) while causing said element (39) to rotate together with said common shaft (B);

whereby said adjusting of the amount of compression of said spring (41') adjusts the amount of said greater resisting torque at which said pipe-bending members disengage.

2. Pipe-ending machine according to claim 1, wherein said speed reducer assembly (60) works with a 1:3 velocity ratio between first and second said sockets (13*a*) and with a 1:2 velocity ratio between second and third said sockets (13*a*).

3. Pipe-bending machine according to claim 1, including a driving device (90) for rotating said common driving shaft (B), and a long forklike device (80) provided with tines (83, 83') interconnecting the machine and the driving device (90) to prevent rotational displacement of said drive device (90) during operation.

* * * * *